United States Patent [19]

Eberhardt et al.

[11] Patent Number: 4,521,654

[45] Date of Patent: Jun. 4, 1985

[54] HIGH VOLTAGE DISCONNECT SWITCH EMPLOYING PRE-CONTACT PIECES

[75] Inventors: Wolfgang Eberhardt, Kassel-Harlh; Dietrich Hoffmann; Karl Kriechbaum, both of Kassel; Erwin Rohde, Helsa, all of Fed. Rep. of Germany

[73] Assignee: Licentia Patent-Verwaltungs-G.m.b.H., Frankfurt am Main, Fed. Rep. of Germany

[21] Appl. No.: 536,033

[22] Filed: Sep. 26, 1983

[30] Foreign Application Priority Data

Sep. 24, 1982 [DE] Fed. Rep. of Germany ..... 3235353

[51] Int. Cl.[3] ..... H01N 33/12

[52] U.S. Cl. ..... 200/146 R; 200/144 R

[58] Field of Search ..... 200/146 R, 144 R, 148 F

[56] References Cited

U.S. PATENT DOCUMENTS 1,815,637 7/1931 Viele ..... 200/146 R

*Primary Examiner*—Robert S. Macon

*Attorney, Agent, or Firm*—Spencer & Frank

[57] ABSTRACT

A high voltage disconnect switch, including a countercontact piece having switch countercontacts and being arranged for connection to a source of high voltage. Resilient pre-contact pieces are insulatingly connected to the countercontact piece and include switch contacts disposed for contacting the switch countercontacts. Movable primary contact pieces are arranged to be movable from a first position of separation from the pre-contact pieces and the countercontact piece to a second position in which the primary contact pieces are in contact with the pre-contact pieces but not with the countercontact piece and to a third position in which the primary contact pieces are in contact with both the pre-contact pieces and the countercontact piece. The pieces are configured and arranged relative to one another so that during the closing of the switch the countercontacts contact the contacts after the primary contact pieces are moved to the second position and before they are moved to the third position, and during the opening of the switch the countercontacts separate from the contacts after the primary contact pieces are moved to the second position and before they are moved to the first position.

13 Claims, 5 Drawing Figures

HIGH VOLTAGE DISCONNECT SWITCH EMPLOYING PRE-CONTACT PIECES

BACKGROUND OF THE INVENTION

The present invention relates to a high voltage disconnect switch, particularly a single pole disconnect switch, which includes primary movable contact pieces, a countercontact piece connected to a high voltage line, and resilient pre-contact pieces connected to the countercontact piece, wherein the pre-contact pieces are arranged to close before the closing of the primary contact pieces during switch closihg and to open before the opening of the primary contact pieces during switch opening.

The contact system of a disconnect switch is generally designed to be switched on and off only in the idle stage, that is, without the presence of a current load. For this reason no measures are generally taken in connection with disconnect switches to increase their turn-on capability or permit the disconnection of load or short-circuit currents.

In certain cases, however, a disconnect switch must be able to have a certain opening and closing capability. Such a case arises, for example, when the switch is used to connect and disconnect a high voltage long line.

If such a switch is also used to connect and disconnect a bus bar section which is connected in parallel with a second current-carrying bus bar section, an electric switching arc may develop during the opening movement of the disconnect contacts.

In known disconnect switches not equipped with special devices to increase their switching capability, the generated switching sparks may damage the contact surfaces. Over the course of time, this reduces the permanent current carrying capability of the switch. Depending on the current load, the aggressivity of the atmosphere and the duration of the influences, damaged contact points may take on such a high transfer resistance that finally the contact pieces may burn out and cause operating malfunctions.

To overcome these drawbacks, German Offenlegungsschrift Pat. No. 2,809,499 discloses equipping the primary contact pieces of a disconnect switch with resilient pre-contact pieces which during the closing of the switch close before the primary contact pieces and during the opening of the switch open after the primary contact pieces so that opening and closing of the primary contact pieces takes place without current. The contact surfaces of the primary contact pieces thus remain protected against the effects of switching arcs.

It has been found, however, that switching arcs damage the contact surface at the point of contact between the pre-contact and primary contact pieces, thus impeding current transfer and shortening the service life of the pre-contact pieces.

SUMMARY OF THE INVENTION

It is therefore an object of the present invention to provide a contact arrangement for high voltage disconnect switches of the above-described type which assures high quality contact surfaces on the primary and pre-contact pieces.

The above and other objects are accomplished in accordance wth the present invention which provides for a high voltage disconnect switch in which a countercontact piece having switch countercontacts is arranged for connection to a source of high voltage. Resilient pre-contact pieces are insulatingly connected to the countercontact piece and include switch contacts disposed for contacting the switch countercontacts. Movable primary contact pieces are arranged to be movable from a first position of separation from the pre-contact pieces and the countercontact piece to a second position in which the primary contact pieces are in contact with the pre-contact pieces but not with the countercontact piece and to a third position in which the primary contact pieces are in contact with both the pre-contact pieces and the countercontact piece. The pieces are configured and arranged relative to one another so that during the closing of the switch the countercontacts contact the contacts after the primary contact pieces are moved to the second position and before the primary contact pieces are moved to the third position, and during the opening of the switch the countercontacts separate from the contacts after the primary contact pieces are moved to the second position and before the primary contact pieces are moved to the first position.

A significant advantage of the disconnect switch according to the present invention is that the arc generated during turn-on and turn-off at the preliminary contact pieces is produced at certain locations which are specially equipped for this purpose so that the service life of the preliminary contact pieces is extended. These locations are advisably provided away from the points of contact which, as the current carrying contacts, should retain their perfect contact surfaces.

DESCRIPTION OF THE PREFERRED EMBODIMENTS

Figure 1A:
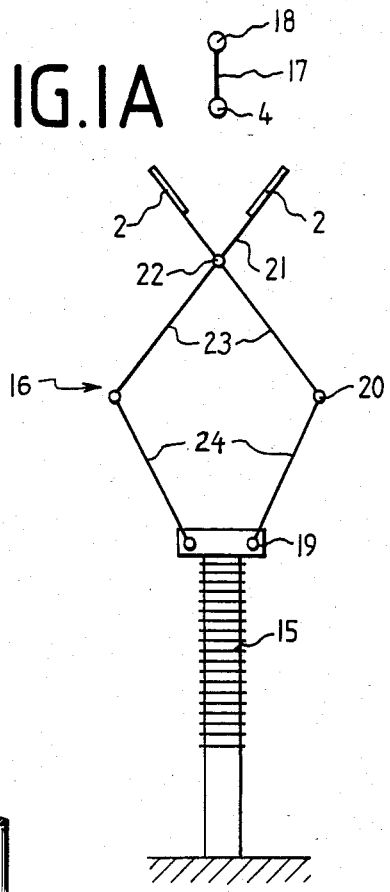
FIG. 1A is an end elevational view of a scissor mechanism used with the switch according to the invention.
Figure 1:
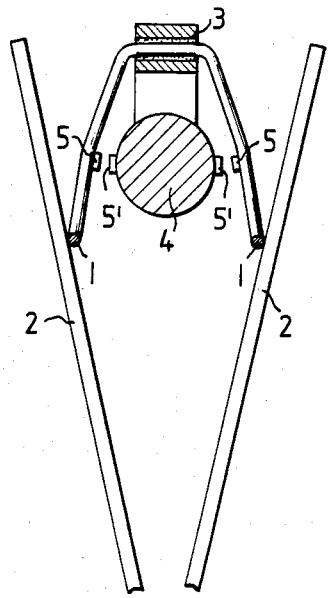
FIG. 1 is an end sectional view of FIG. 2 and other components of a disconnect switch according to the invention.

FIG. 1 illustrates an arrangement of contacts that can be used in a high voltage disconnect switch according to the invention. The arrangement includes resilient pre-contact pieces 1, which cooperate with movable primary contact pieces 2. Pre-contact pieces 1 are fastened in an insulating mount 3 at a countercontact piece 4. Switching contacts 5 are disposed at pre-contact pieces 1 and countercontacts 5' cooperating therewith are disposed at countercontact piece 4.

Primary contact pieces 2 are disposed at scissor arms and, during the switch closing process, pre-contact pieces 1 first come into contact in a known manner with primary contact pieces 2. Moreover, since the pre-contact pieces 1 are fastened in insulating mount 3 at countercontact piece 4, the circuit is closed only in the course of a further closing movement, that is, when pre-contact pieces 1 electrically conductively contact countercontact piece 4. This contact occurs first at switch contacts 5, 5'. Subsequently, movable primary contacts 2 come into contact with countercontact 4. Switch contacts 5, 5′ also take over the function of disconnecting residual or commutation currents during the switch opening procedure performed by the disconnect switch. During switch opening, contacts 5, 5′ open after separation of primary contact pieces 2 from countercontact piece 4 and before the separation of primary contact pieces 2 from pre-contact pieces 1. Switch contacts 5, 5′ are preferably protected against consumption caused by any arc occurring during switch opening in that they are equipped with burn resistant material, such as tungsten or alloys of tungsten.

Figure 2:
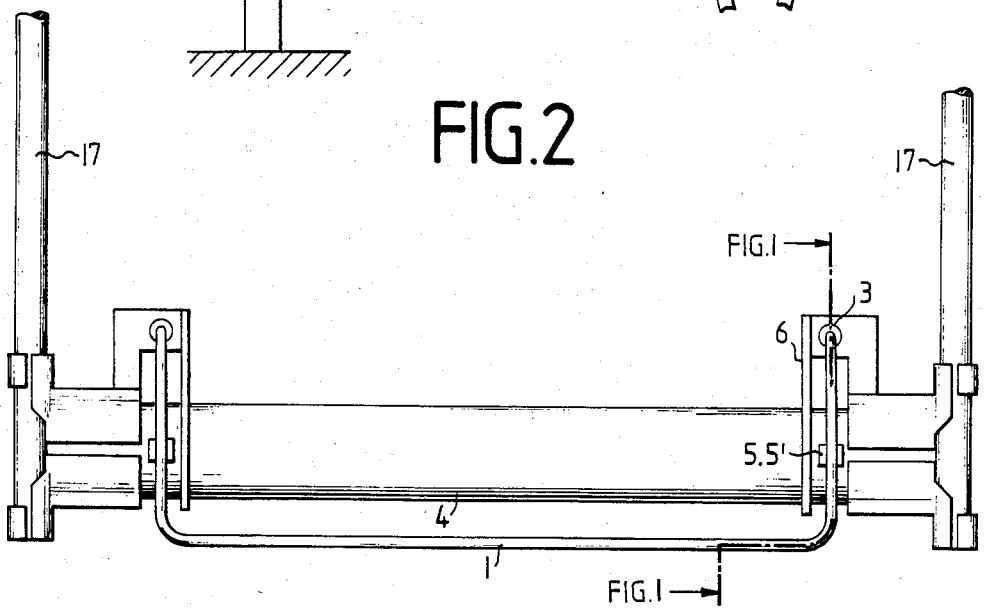
FIG. 2 is a side elevation view of components of a disconnect switch according to the invention.

FIG. 2 shows the position of switch contacts 5 and the shape of pre-contact pieces 1. Pre-contact pieces 1 have the shape of the letter C and are mounted in insulating mounts 3. Mounts 3 and switch contacts 5, 5′ are arranged at the ends of countercontact piece 4 with a baffle 6, made for example of plastic, being provided as protection against possible influences on the surface of the countercontact piece 4 by the switching arc. Additionally, baffle 6 prevents the lateral sudden impact of the scissor arm, for example as the result of storing short-circuiting forces, against the switch contact arrangement of pre-contact pieces 1.

A known scissor type disconnecting switch mechanism is shown in FIG. 1A, which may be employed in carrying out the invention. This scissor type switch mechanism comprises a porcelain column 15 and scissors 16. Primary contacts 2, which are securely screwed onto the handles of upper scissor arms 21, are fastened at the upper ends of scissors 16. When scissors 16 are extended during the process of closing the switch, primary contacts 2 are, in the closed state, pressed onto both sides of stationary countercontact piece 4 which is fastened to a conductor cable 18 by means of holding pieces 17. The switch closing and opening movements are actuated by a known mechanism disposed in a housing 19 which is arranged on porcelain column 15. During the switch closing process, the lower arms 23 and 24 of scissors 16 are turned inwards by means of the shaft of the mechanism in housing 19, whereby the buckling joints 20 are extended, thus moving upper scissor arms 21, equipped with primary contacts 2, towards each other by means of the swivel joint 22, squeezing countercontact piece 4 in the closed state of the switch.

In FIG. 1 pre-contact pieces 1 form part of a one-piece resilient arc-shaped component disposed in holding device 3 and insulated from countercontact piece 4. During the switch closing movement, movable primary contact pieces 2 initially come into currentless contact with pre-contact pieces 1. In the course of a further movement, contact occurs between contact 5 and countercontact 5′. Movable primary contact pieces 2 continue to move, elastically deform pre-contact pieces 1, and are subsequently pressed against both sides of countercontact piece 4.

Figure 3:
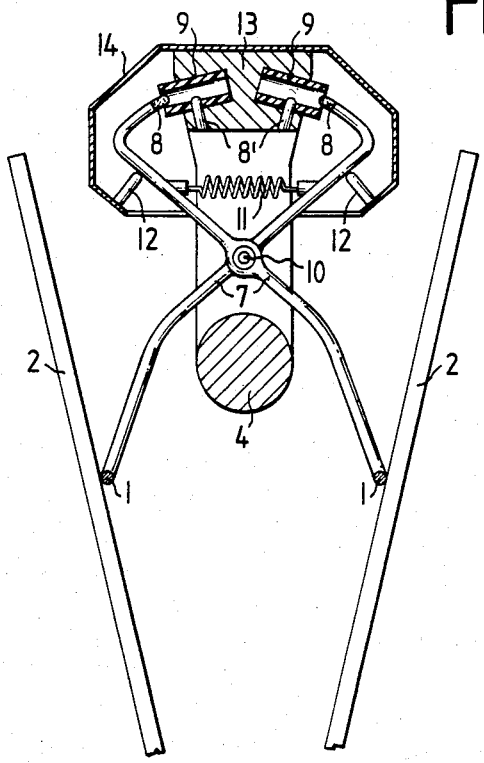
FIG. 3 is an end sectional view of FIG. 4 and other components of a disconnect switch according to the invention.
Figure 4:
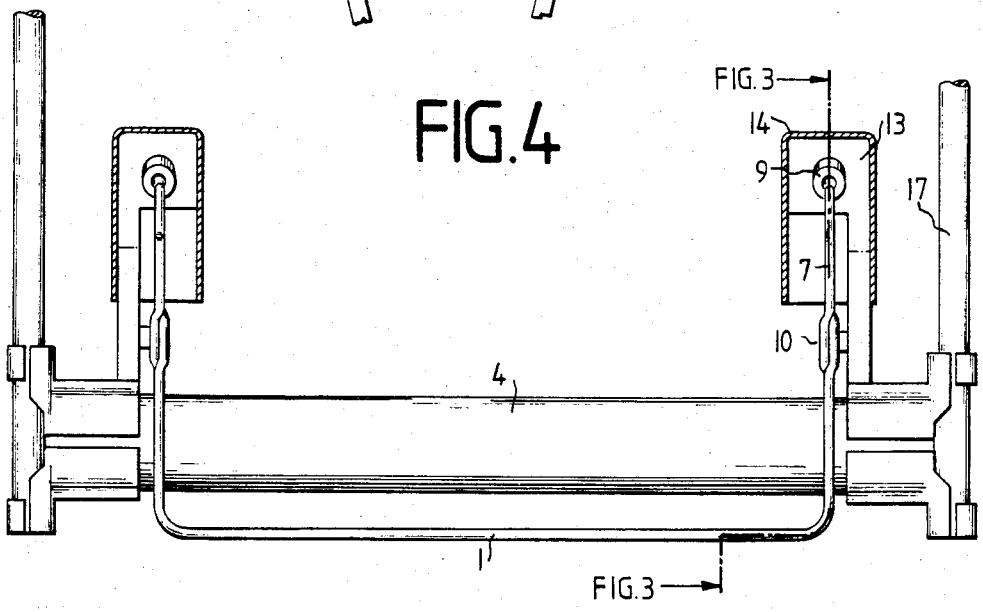
FIG. 4 is a side elevation view of components of a disconnect switch according to another embodiment of the invention.

FIGS. 3 and 4 illustrate another embodiment of the disconnect switch according to the invention which has the advantage that the stroke of the contact pieces of switch contacts 8 is made substantially longer because the stroke of pre-contact pieces 1 is transferred by a two-armed lever system 7 to switch contacts 8, 8′, rather than a one-armed system as in the embodiment of FIGS. 1 and 2. This results in an increase in the switching speed and in the stroke at the contact location. The common fulcrum 10 of lever system 7 is insulated with respect to countercontact piece 4 and the levers themselves of lever system 7. The switching speed is determined by appropriate selection of the position of fulcrum 10 and the length of the levers of lever system 7. A spring 11, for example a compression spring, assures that pre-contact pieces 1 are spread apart in the off state. An abutment 12 limits this spread.

The arcs generated during switch opening must be quenched as quickly as possible to avoid unnecessary consumption by burning. A quenching device 9 made of a hard gas material is provided for this purpose. This material is arranged in the immediate vicinity of switch contacts 8, 8′ so that an intensive gas stream is generated upon development of the arc to cause the arc to be quenched. The hard gas material may be provided in the form of a sleeve which accommodates switch contacts 8, 8′ in its interior, with movable switch contact 8 moving approximately in the axis of the sleeve while the fixed switch contact 8′ enters, as a resilient contact piece, for example, radially into sleeve 9. The stationary switch contacts 8′ are connected with countercontact piece 4 via a contact support 13. A quick separation of switch contacts 8, 8′ within gas emitting quenching device 9 results in a shorter arc time and a rapid quenching of the arc occurring during the opening of the switch.

The protection of switch contacts 8, 8′, of quenching device 9, as well as of the upper portion of lever system 7, against the influences of weather is provided by a hood 14 which may be made of metal or a weather resistant plastic.

During the switch closing process of the switch illustrated in FIGS. 3 and 4, movable primary contact pieces 2 are moved by a scissors type mechanism, such as shown in FIG. 1A, so that they initially make currentless contact with pre-contact pieces 2 as in the operation of the switch in FIGS. 1 and 2. Further movement of primary contact pieces 1 brings contacts 8 and countercontacts 8′ into sliding contact. Contacts 8 continue to slide against countercontacts 8′ so that pre-contact pieces 1 can continue to be moved without elastic deformation until primary contact pieces 2 are pressed against both sides of countercontact piece 4.

Quenching device 9 may be made, for example, of an acetal resin, as sold by Dupont under the trade name "Tellerin".

It will be understood that the above description of the present invention is susceptible to various modifications, changes and adaptations, and the same are intended to be comprehended within the meaning and range of equivalents of the appended claims.

What is claimed is:

1. A high voltage disconnect switch, comprising:

a countercontact piece having switch countercontacts and being arranged for connection to a source of high voltage;

resilient pre-contact pieces insulatingly connected to said countercontact piece and including switch contacts disposed for contacting said switch countercontacts; and movable primary contact pieces arranged to be movable from a first position of separation from said pre-contact pieces and said countercontact piece to a second position in which said primary contact pieces are in contact with said pre-contact pieces but not with said countercontact piece and to a third position in which said primary contact pieces are in contact with both said pre-contact pieces and said countercontact piece;

wherein said pieces are configured and arranged relative to one another so that during the closing of said switch said countercontacts contact said contacts after said primary contact pieces are moved to the second position and before said primary contact pieces are moved to the third position, and during the opening of said switch said countercontacts separate from said contacts after said primary contact pieces are moved to the second position and before said primary contact pieces are moved to the first position.

2. A switch as defined in claim 1, wherein said contacts and countercontacts are composed of a burn-resistant material.

3. A switch as defined in claim 2, wherein said burn-resistant material is one of tungsten and a tungsten alloy.

4. A switch as defined in claim 1, and further comprising a material surrounding said contacts and countercontacts for emitting a quenching gas upon the occurrence of an arc.

5. A switch as defined in claim 4, wherein said material has the shape of sleeve which accommodates said contacts and countercontacts in its interior.

6. A switch as defined in claim 5, wherein at least said countercontact is resilient.

7. A switch as defined in claim 1, wherein said pre-contact pieces each have a C-shape construction presenting a one-arm lever system having a fulcrum insulatingly connected with said countercontact piece for moving each said contact into contact with a respective one of said countercontacts.

8. A switch as defined in claim 1, wherein said pre-contact pieces are configured as a dual-arm lever system having a fulcrum insulatingly connected to said countercontact piece for moving each said contact into contact with a respective one of said countercontacts.

9. A switch as defined in claim 1, and further including a spring positioned for spreading apart said pre-contact pieces.

10. A switch as defined in claim 1, and further including an abutment disposed for limiting the stroke of said pre-contact pieces.

11. A switch as defined in claim 1, and further including a hood disposed for covering, at least in part, said contacts and countercontacts.

12. A switch as defined in claim 11, wherein said hood is made of weather-resistant material.

13. A switch as defined in claim 1, wherein said switch is a single pole disconnect switch.

* * * * *